US007235005B2

(12) United States Patent
Schnell et al.

(10) Patent No.: US 7,235,005 B2
(45) Date of Patent: Jun. 26, 2007

(54) BELT SANDER

(75) Inventors: John W. Schnell, Anderson, SC (US); Daniel Paxton Wall, Humboldt, TN (US)

(73) Assignee: Black & Decker Inc., Newark, DE (US)

( * ) Notice: Subject to any disclaimer, the term of this patent is extended or adjusted under 35 U.S.C. 154(b) by 42 days.

(21) Appl. No.: 11/089,447

(22) Filed: Mar. 24, 2005

(65) Prior Publication Data

US 2006/0264161 A1 Nov. 23, 2006

(51) Int. Cl.
*B24B 23/00* (2006.01)
*B24B 27/08* (2006.01)

(52) U.S. Cl. ..... 451/355; 451/344; 451/348

(58) Field of Classification Search ..... 451/344, 451/348, 355
See application file for complete search history.

(56) References Cited

U.S. PATENT DOCUMENTS

| | | | |
|---|---|---|---|
| 2,232,149 | A | 2/1941 | Tautz |
| 2,260,949 | A | 10/1941 | Mall |
| 2,289,481 | A | 7/1942 | Burleigh |
| 2,742,741 | A | 4/1956 | Lars |
| 2,783,818 | A | 3/1957 | Kenny |
| 3,312,116 | A | 4/1967 | Blevins |
| 3,331,165 | A | 7/1967 | Blevins |
| 3,359,689 | A | 12/1967 | McCarty et al. |
| 3,362,111 | A | 1/1968 | Foell et al. |
| 3,363,367 | A | 1/1968 | Blevins et al. |
| 3,393,573 | A | 7/1968 | Beckering et al. |
| 3,431,686 | A | 3/1969 | Bergler |
| 3,496,679 | A | 2/1970 | Dunn |
| 3,566,548 | A | 3/1971 | Beckering et al. |
| 3,682,010 | A | 8/1972 | Brooks et al. |
| 3,757,382 | A | 9/1973 | Brooks et al. |
| 4,075,523 | A | 2/1978 | Lafferty |
| 4,115,957 | A | 9/1978 | Porth et al. |
| 4,118,797 | A | 10/1978 | Tarpley |
| 4,163,167 | A | 7/1979 | Zelt et al. |
| 4,177,609 | A | 12/1979 | Rameckers et al. |
| 4,195,449 | A | 4/1980 | Scarpa |
| D255,319 | S | 6/1980 | Schultz et al. |
| 4,213,288 | A | 7/1980 | Takeuchi et al. |

(Continued)

FOREIGN PATENT DOCUMENTS

| | | |
|---|---|---|
| DE | 2632184 | 1/1977 |
| DE | 3147418 | 6/1983 |

(Continued)

OTHER PUBLICATIONS

"Bosch 2002/2003 Catalog", 80-81.
"Porter Cable 2004-2005 Catalog", 42-44.

*Primary Examiner*—Joseph J. Hail, III
*Assistant Examiner*—Shantese L. McDonald

(57) ABSTRACT

A sander comprised of a high voltage direct current motor for providing rotational torque to the sander is disclosed. In an exemplary embodiment, a motor housing generally encompasses the motor for enclosure of the motor. The motor housing being generally contoured to be received by a human hand and sized to a generally sized human hand. Further, a sanding assembly is operationally coupled to the motor housing for providing an abrasive surface to be used to sand a desired surface. The use of a voltage direct current motor allows the belt sander to be generally the size of a human hand.

16 Claims, 4 Drawing Sheets

U.S. PATENT DOCUMENTS

| | | | | |
|---|---|---|---|---|
| 4,242,839 | A | 1/1981 | Armbruster et al. | |
| 4,305,180 | A | 12/1981 | Schwartz | |
| 4,316,349 | A | 2/1982 | Nelson | |
| 4,334,390 | A | 6/1982 | Sumerau | |
| 4,403,454 | A | 9/1983 | Glore | |
| 4,420,703 | A | 12/1983 | Adam et al. | |
| 4,510,718 | A | 4/1985 | Eichenlaub | |
| 4,559,465 | A | 12/1985 | Gagneux | |
| D282,078 | S | 1/1986 | House, II | |
| 4,574,531 | A | 3/1986 | McCurry | |
| 4,584,797 | A | 4/1986 | Wanninkhof et al. | |
| 4,593,220 | A | 6/1986 | Cousins et al. | |
| D286,737 | S | 11/1986 | House, II | |
| 4,627,624 | A | 12/1986 | Usui | |
| 4,638,196 | A | 1/1987 | Kranzler | |
| 4,673,837 | A | 6/1987 | Gingerich et al. | |
| 4,677,329 | A | 6/1987 | Secoura | |
| 4,694,616 | A | 9/1987 | Lindberg | |
| 4,748,353 | A | 5/1988 | Klingenstein et al. | |
| 4,896,462 | A | 1/1990 | Farmerie | |
| 4,924,633 | A | 5/1990 | Hock et al. | |
| 5,007,205 | A | 4/1991 | Farmerie | |
| 5,251,406 | A | 10/1993 | Kirm | |
| 5,319,887 | A | 6/1994 | Walz et al. | |
| 5,397,952 | A | 3/1995 | Decker et al. | |
| 5,403,229 | A | 4/1995 | Seli | |
| 5,643,062 | A * | 7/1997 | Joseph et al. | 451/355 |
| 5,833,524 | A | 11/1998 | Satoh et al. | |
| 5,860,854 | A | 1/1999 | Sakoh et al. | |
| 6,031,313 | A | 2/2000 | Sugai et al. | |
| 6,048,297 | A | 4/2000 | Lange et al. | |
| 6,163,096 | A | 12/2000 | Michenfelder et al. | |
| 6,174,226 | B1 * | 1/2001 | Frech et al. | 451/355 |
| 6,206,771 | B1 | 3/2001 | Lehman | |
| 6,218,746 | B1 | 4/2001 | Gouge | |
| 6,248,007 | B1 * | 6/2001 | deBlois et al. | 451/344 |
| 6,419,569 | B1 | 7/2002 | Frech et al. | |
| 6,475,075 | B1 * | 11/2002 | Wuensch | 451/355 |
| 6,494,636 | B1 | 12/2002 | Mozena | |
| 6,544,112 | B1 | 4/2003 | Fuchs | |
| 6,617,726 | B1 | 9/2003 | Tsergas | |
| 6,632,128 | B2 | 10/2003 | Berger et al. | |
| 6,648,737 | B2 | 11/2003 | Deware | |
| D487,008 | S | 2/2004 | Andriolo | |
| 6,688,349 | B2 | 2/2004 | Razlan et al. | |
| 6,725,892 | B2 | 4/2004 | McDonald et al. | |
| 6,744,170 | B1 | 6/2004 | Du | |
| D492,563 | S | 7/2004 | Wright | |
| 6,758,731 | B2 | 7/2004 | Dutterer | |
| D508,833 | S | 8/2005 | Brazell et al. | |
| 7,034,431 | B2 | 4/2006 | Kapitza | |
| D520,317 | S | 5/2006 | Robson | |
| 7,101,274 | B1 | 9/2006 | Etter et al. | |
| D529,775 | S | 10/2006 | Leasure | |
| 2002/0009960 | A1 | 1/2002 | Swaddle | |
| 2005/0048883 | A1 | 3/2005 | Melvin et al. | |
| 2005/0079810 | A1 | 4/2005 | Melvin et al. | |
| 2005/0146239 | A1 | 7/2005 | Kapitza | |
| 2005/0264127 | A1 | 12/2005 | Benkert | |
| 2005/0272356 | A1 | 12/2005 | Walker et al. | |
| 2005/0272357 | A1 | 12/2005 | Walker | |
| 2006/0211347 | A1 | 9/2006 | Wall et al. | |

FOREIGN PATENT DOCUMENTS

| | | | |
|---|---|---|---|
| DE | 3390138 | | 7/1984 |
| DE | 8520256 | | 10/1985 |
| DE | 8520258 | | 10/1985 |
| DE | P3535636.7 | | 4/1987 |
| DE | 3644389 | | 7/1988 |
| DE | 3644390 | | 7/1988 |
| DE | P3823391.6 | | 1/1990 |
| DE | 49812037 | | 8/1999 |
| DE | 062572 | | 2/2003 |
| DE | 10203489.3 | | 7/2003 |
| DE | 10319173.9 | | 11/2004 |
| DE | 10347697.3 | | 5/2005 |
| EP | 0088234 | A1 | 9/1983 |
| EP | 0158065 | | 10/1985 |
| EP | 0195929 | | 10/1986 |
| EP | 0851541 | | 7/1998 |
| EP | 0920723 | | 6/1999 |
| EP | 0935318 | | 8/1999 |
| EP | 1013383 | | 6/2000 |
| EP | 1129822 | | 9/2001 |
| EP | 1175281 | | 1/2002 |
| EP | 1528656 | | 5/2005 |
| EP | 1604780 | | 12/2005 |
| EP | 1604781 | | 12/2005 |
| GB | 1075904 | | 7/1967 |
| GB | 1081736 | | 8/1967 |
| GB | 2321865 | | 8/1998 |
| WO | IB-2005/102603 | | 11/2005 |
| WO | WO-2006078966 | A2 | 7/2006 |

* cited by examiner

BELT SANDER

FIELD OF THE INVENTION

The present invention relates to the field of woodworking and particularly to a belt sander.

BACKGROUND OF THE INVENTION

Woodworkers often have to smooth the surface of a workpiece prior to the completion of a woodworking project. For example, most workpieces require at least a minimal amount of sanding in order to remove any excess glue or rough edges prior to completion of the project. Currently, a number of different types of sanders are available to improve the surface quality and appearance of a workpiece. Such sanders range from a piece of sandpaper wrapped around a scrap of wood to motorized sanders including orbital sanders and quarter pad finishing sanders.

The selection of a specific type of sander depends upon the condition and type of workpiece. For example, for finer finishing work a quarter pad finishing sander or an orbital sander may be utilized. Both a quarter pad finishing sander and orbital sander utilize a sandpaper pad connected onto a plate on the bottom of the sander. Further, the height and shape of the housing of a quarter pad finishing sander is substantially similar to that of an orbital sander (e.g. relatively tall and conical in shape). The pattern of movement is different, however, between such sanders whereby the quarter pad finishing sander moves the pad back and forth while an orbital sander moves such pad in a small circular motion. Due to the type of action implemented by these sanders, however, if a woodworker desires to remove material quickly a more aggressive sander might be employed.

Although the conventional motorized sanders, e.g. orbital sanders and quarter pad finishing sanders, have increased the ease in which sanding may be performed, such sanders are disadvantageous in certain circumstances. First, current orbital sanders and quarter pad sanders are often relatively tall which results in a greater distance between the operator's hand and the work piece and the chance that the sander may drift. Further, the shape of such sanders is often conical which is difficult to grasp and thus, difficult for the user to control. For example, a user is often required to grip the sander in such a manner that one's hand is perpendicular to the sanding assembly. In addition, such sanders are designed mostly for finer finishing work in which the sander is designed to remove material more slowly when compared to other configurations of sanders. The currently available more aggressive type of sanders are often undesirable for they are typically large, bulky, and cumbersome to operate.

Therefore, it would be desirable to design a sander with a contour and size which allowed the user to exert better control over such sander while in use.

SUMMARY OF THE INVENTION

Accordingly, the present invention is directed to a belt sander. In exemplary embodiments, the belt sander includes a high voltage direct current motor for providing rotational torque to the sander is disclosed. In an exemplary embodiment, a motor housing generally encompasses the motor for enclosure of the motor and motor control components. The motor housing is generally contoured to be received by a human hand and sized to a generally sized human hand. Further, a sanding assembly is operationally coupled to the motor housing for providing an abrasive surface to be used to sand a desired surface. The sanding assembly includes a plurality of rollers, the plurality of rollers including a front roller and a rear roller, the front roller being of a smaller diameter than the rear roller. The motor housing generally contoured to be received by the human hand and sized to the generally sized human hand allows a user to control the belt sander with one hand.

In specific aspects of the present invention, the motor is oriented in line with the direction of travel of the sanding assembly. Further, a power switch may be disposed within the front of the housing to control the transmission of electricity to the motor. In addition, a variable speed switch or dial may be disposed within the front of the housing to allow a user to vary the speed of the motor. In additional embodiments, the motor housing is contoured so that a user's hand and wrist occupy different planes during use of the belt sander. Moreover, the belt sander may include a gearing system for transmitting torque to the sanding assembly. In an exemplary embodiment, such gearing system is enclosed by a gear housing to prevent dust and debris from entering the gearing system and for dampening noise. In still further embodiments, the motor housing contouring defines an indentation for a user's thumb.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings. It is to be appreciated that corresponding reference numbers refer to generally corresponding structures.

Referring in general to FIGS. 1–6, a belt sander in accordance with the present invention is provided. The instant sander body is contoured to allow a woodworker to easily grip the sander and apply the sander to a workpiece.

In an exemplary embodiment, the motor housing is substantially contoured to be received by a human hand. For example, the entire motor housing is configured to conform to a user's hand. In a further embodiment, the front roller of the sanding assembly is of a smaller diameter than the diameter of the rear roller adjacent to a power cord. Thus, the resulting configuration of the present belt sander allows a woodworker to exert better control over the leading edge of the sander by providing an ergonomically configured motor housing. The present invention therefore permits efficient control over the belt sander thereby overcoming the drawbacks experienced with the prior art. In addition, the instant belt sander permits material removal in limited work environments whereby the use of a high voltage direct current motor provides rotational torque to the sanding assembly in manner allowing the sander to be compact in size.

Figure 1:
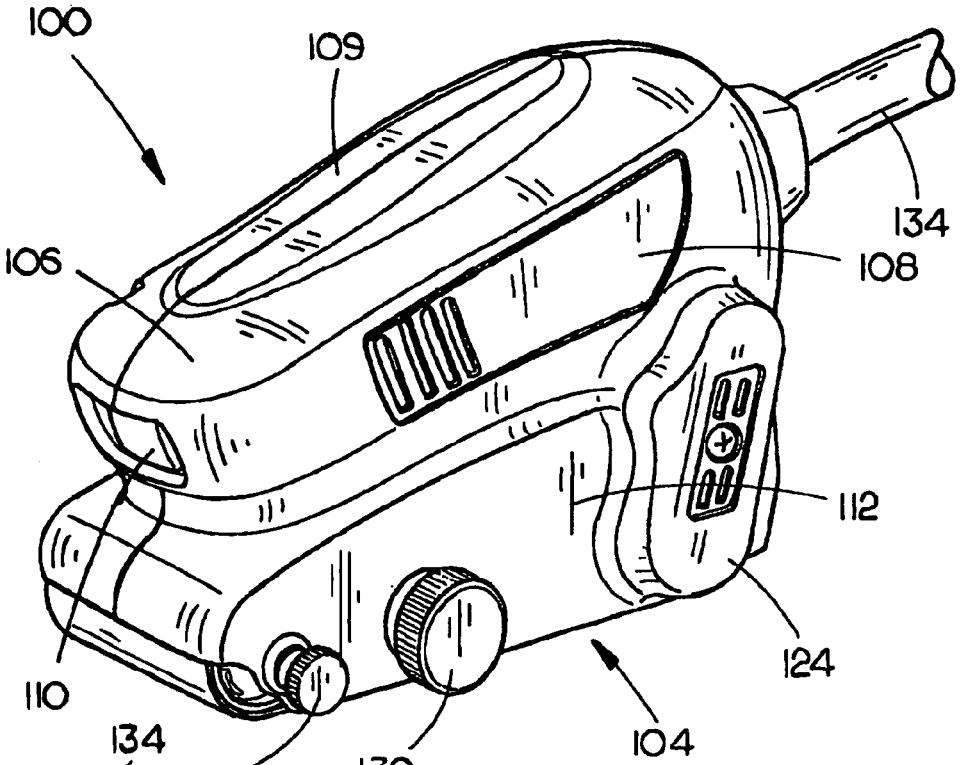
FIG. 1 is an isometric illustration of a belt sander in accordance with the present invention.
Figure 4:
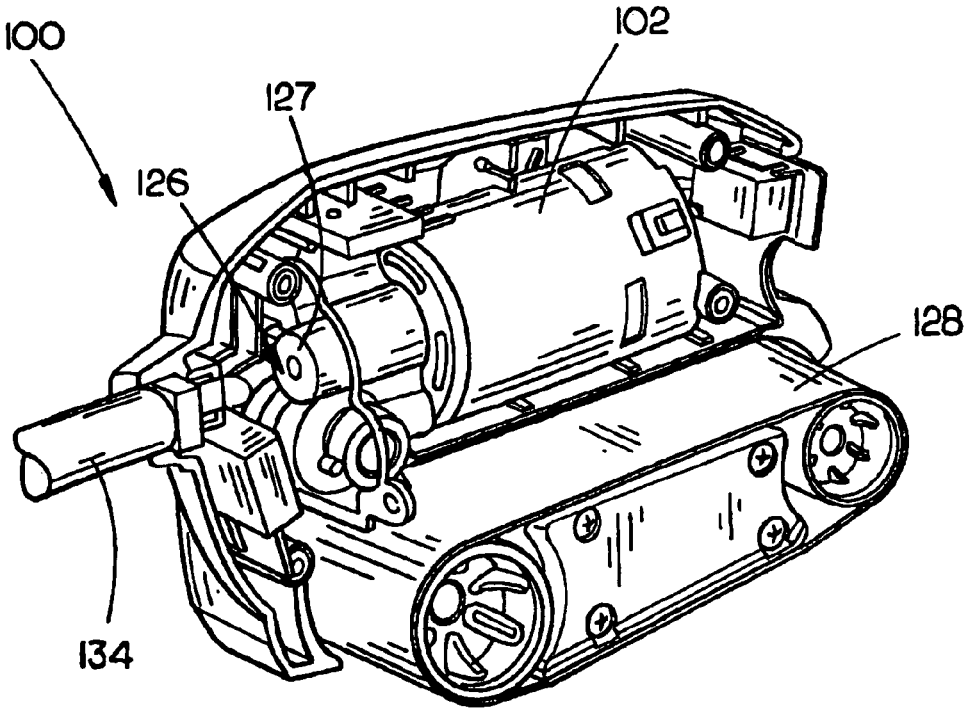
FIG. 4 is an isometric view of the belt sander shown in FIG. 1, wherein the motor housing is removed revealing a gearing system, including a gear housing, for transmitting torque to the drive belt pulley.

Referring specifically to FIG. 1, a belt sander 100 in accordance with an exemplary embodiment of the present invention is provided. The belt sander 100 includes a motor 102 (as shown in FIG. 4) for providing rotational torque to a sanding assembly 104 included within the belt sander 100. In an exemplary embodiment, a high voltage direct current (HVDC) motor is included in lieu of a traditional induction or synchronous motors. Use of a HVDC motor offers improved efficiency, multi-speed control and less/lower frequency noise when compared to traditional induction or synchronous motors. Additionally, in an exemplary embodiment, the motor 102 axis is oriented in-line with the direction of travel of a sanding assembly 104. The in-line configuration of the motor 102 allows the weight of the motor 102 to be uniformly distributed over substantially the entire sanding interface. The in-line configuration allows the assembly to be lighter, when compared to transverse belt sanders, which is advantageous for decreasing user fatigue especially if a user is performing sanding overhead.

As illustrated by FIG. 1, in an exemplary embodiment of the present invention, a motor housing encloses the motor 102 and motor control components. In the exemplary embodiment, the housing motor 106 is contoured to provide a griping surface for a user. For example, the motor housing 106 is configured to the shape of a user's palm so that the user's palm is place directly over the motor housing 102 so that in use the user's hand and wrist are parallel with the direction of travel of the sanding assembly. Such configuration is advantageous over conventional belt sanders for it allows the user to maintain sufficient control of the sander.

In exemplary embodiments, the housing is formed of materials which include the desired rigidity, machinability and impact resistance such as polyvinyl chloride (PVC), acrylonitrate-butadiene-styrene (ABS), ultra high molecular weight polyethylene (UHMW) plastic, and the like. In additional embodiments, soft grip sides 108 and top 109 are included to reduce vibration transferred to the user and allow a user to maintain efficient control over the sander 100 by providing an easier to grip surface. In such embodiments, the soft grip sides 108 may be formed of elastomeric material such as foam, rubber, rubber impregnated with gel, or the like. It is contemplated that gripping pads may be included in addition to or instead of soft grips sides.

Figure 6:
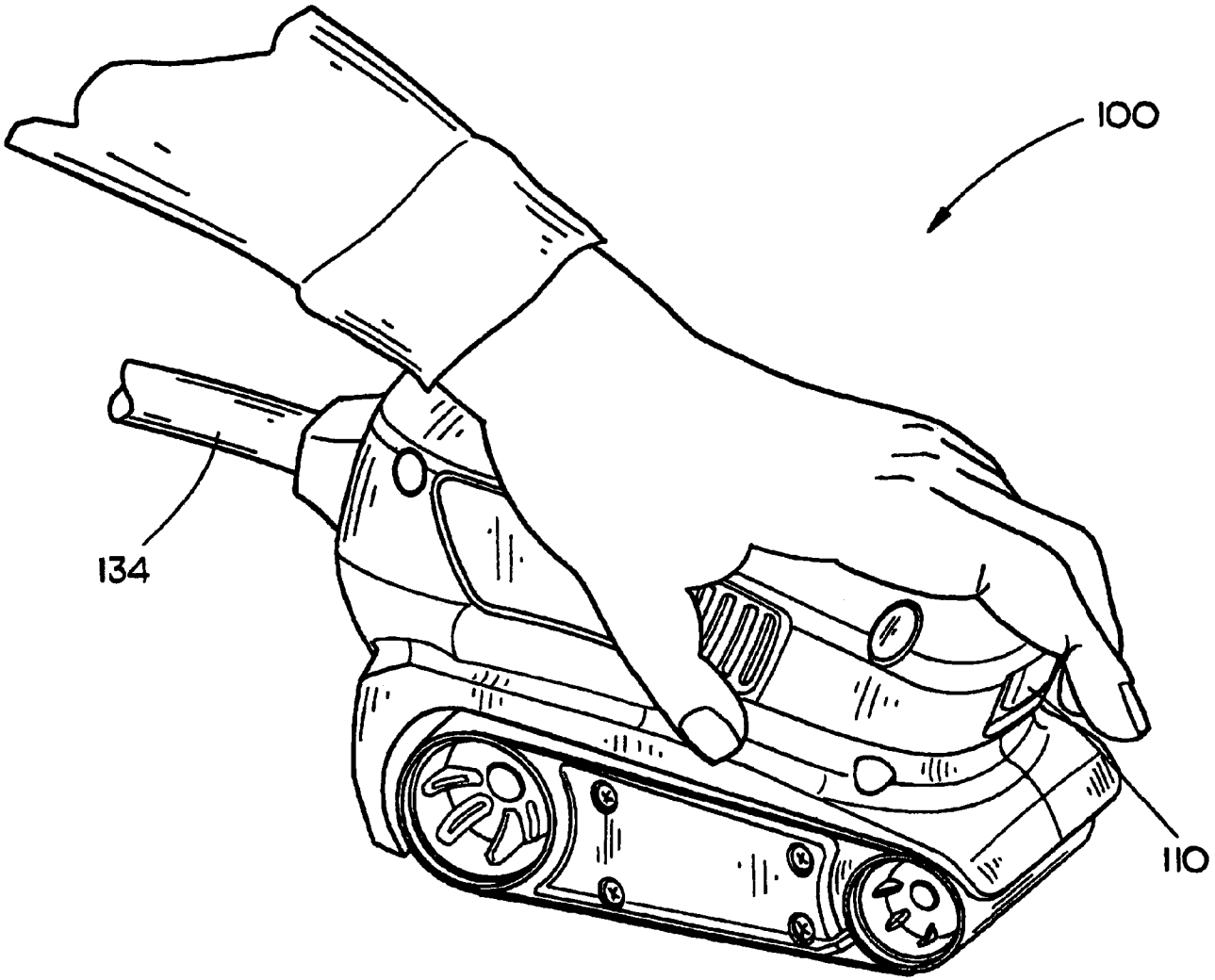
FIG. 6 is an isometric view of the belt sander shown in FIG. 1, wherein the placement of a user's hand is illustrated.

In further additional embodiments of the present invention, the belt sander 100 includes a power cord 134 and switch 110 to control power transmission to the motor 102 and motor components. In an exemplary embodiment, the power cord 134 is located on the rear of the motor housing 106 to allow operation of the belt sander 100 without interference of the power cord 134. The rear of the motor housing 106 being defined as the part of the sander 100 which is covered by the a user's wrist and the lower edge of a user's palm. In further exemplary embodiments, the power switch 110 is located on the front of the housing 106 relative to the power cord 134. Such configuration allows a user to grip the belt sander 100 via the side grips 108, gripping pads or the like while minimizing inadvertent manipulation of the power switch 110 (as illustrated in FIG. 6). However, the power switch 110 is within a finger's reach allowing a user to reach the switch 110 if desired.

In additional embodiments, the belt sander 100 includes a mechanism to allow for speed variation. For example, in one embodiment, the power switch 110 is a multi-positional switch allowing a user to vary motor speed as desired. Use of the HVDC motor, as described above, allows the belt sander to be capable of operating at various speeds. In an exemplary embodiment, the switch 110 is located on the front of the motor housing 106 relative to the power cord 134 allowing a user to alter the speed of the sander without the user having to vary gripping position orientation. In further exemplary embodiments, the belt sander 100 includes a separate switch/dial for speed variation. In such embodiment, the additional switch/dial may also be located on the front of the motor housing 106 relative to the power cord 134. The present configuration allows motor speed to be varied without the user having to vary gripping position orientation. For example, the switch/dial may be configured so that it may be manipulated by a user's index finger. Further, the dial may denote pre-defined increments of variations in speed. In addition, the dial may also allow for smaller incremental variations in speed within the pre-defined increments.

In an exemplary embodiment, the belt sander includes the sanding assembly 104. Such assembly 104 is enclosed by a skirt 112 of the motor housing 106. In exemplary embodiments, the skirt 112 is formed of materials which include the desired rigidity, machinability and impact resistance such as polyvinyl chloride (PVC), acrylonitrate-butadiene-styrene (ABS), ultra high molecular weight polyethylene (UHMW) plastic, and the like. In an advantageous embodiment, the skirt 112 is light weight and contoured to the general size of the motor housing 106. Further, the skirt 112 protects the components within the sanding assembly 104 from damage as well as prevents dust and debris from entering the assembly 104.

Figure 2:
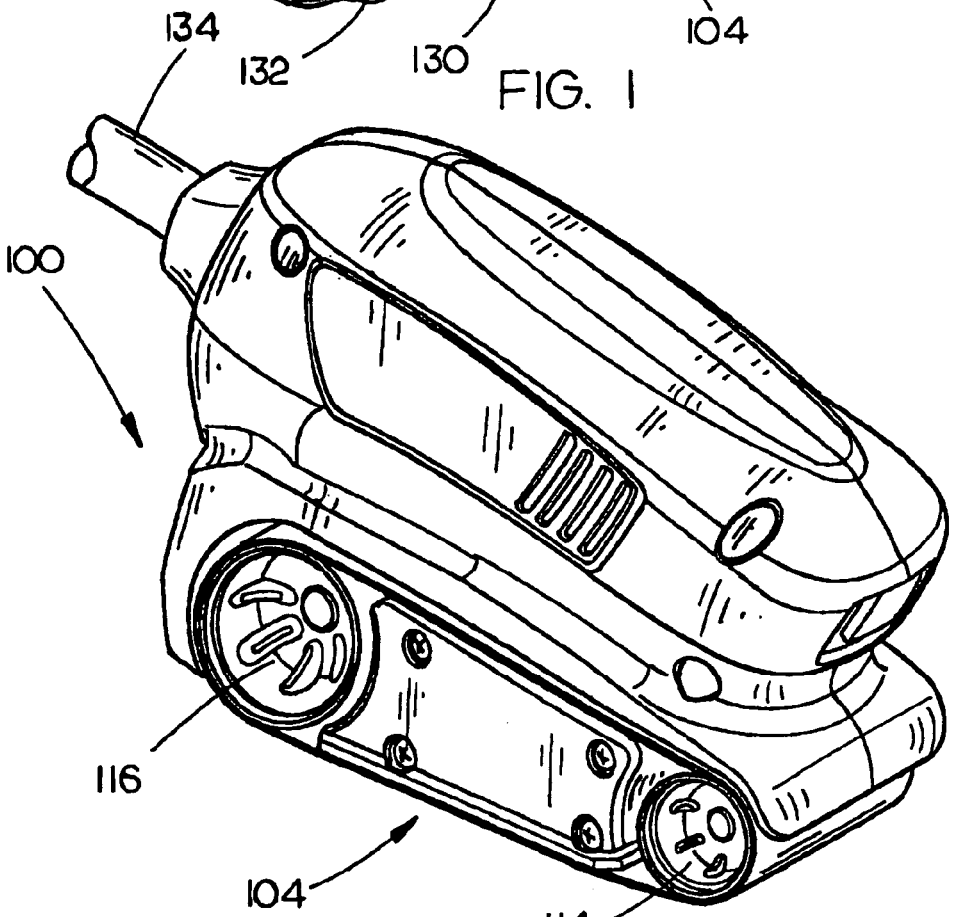
FIG. 2 is an alternate side view of the belt sander shown in FIG. 1.

As illustrated in FIG. 2, the sanding assembly 104 includes a front roller 114 and a rear roller 116 relative to the power cord 134. In an exemplary embodiment, the front roller 114 is of a smaller diameter than the rear roller 116 resulting in the rake of the motor housing 106 to be at an incline. Such configuration provides an inclined grip surface allowing a user hand, wrist and elbow to align in various planes. Providing the ability for the user's hand, wrist, and elbow allow the user to control the sander with one hand while in use whereby the inclined grip surface allows the sander 100 to fit snugly in the palm of the user's hand providing a user with better control over the leading edge of the belt sander 100 when a user's arm is angled. For example, the mushroom contour of the belt sander 100 allows a user to grip the sander 100 with one's thumb resting within a lower channel or recess. In further exemplary embodiments, the front roller 114 is an idle roller. In an alternative embodiment, power is transmitted to the front roller 114 from the rear roller 116 via a transmission system.

In additional exemplary embodiments, the sanding assembly 104 includes a pulley system which transmits the torque provided from the motor 102 to the sanding assembly 104. The pulley system includes a plurality of pulleys and belts.

Figure 3:
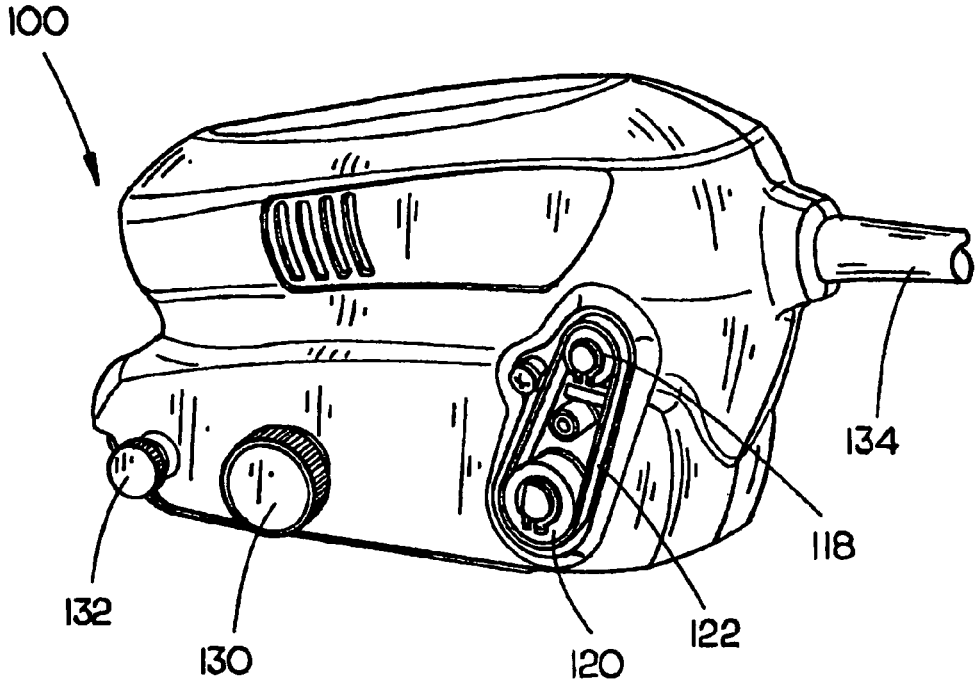
FIG. 3 is a partial side view of the belt sander shown in FIG. 1, wherein a sanding assembly including a drive belt pulley and a pitch belt is illustrated.

As illustrated in FIG. 3, in an exemplary embodiment the plurality of pulleys include a drive belt pulley 118 and a driven pulley 120. Further, in such embodiment, a pitch belt 122 is present to transfer rotation from the drive belt pulley 118 to the driven pulley 120 which is connected to the rear sanding belt roller 116. In an advantageous embodiment, the width of the pitch belt 122 is three (3) millimeters. Such size of belt allows rotation to be transferred from the drive belt pulley 118 to the driven pulley 120 effectively while minimizing the footprint of the belt sander 100. Additionally, the plurality of pulleys and the pitch belt are enclosed by a belt or transmission housing 124 (shown in FIG. 1). Such housing 124 prevents dust and debris from entering and possibly interfering with the function of various components.

In even further exemplary embodiments, as illustrated in FIG. 4, power is transmitted to the drive belt pulley 118 via a gearing system 126. In an advantageous embodiment, the gearing system 126 is a crossed helical gearing system or a worm-drive gearing system is utilized to transmit power to the drive belt pulley 118. The use of a crossed helical gearing system or a worm-drive gearing system is advantageous for such systems reduce vibration/noise generated during operation as well as the stress placed on the gearing system in comparison to alternative gearing systems (e.g. spur gearing systems). In additional embodiments, the gearing system 126 is enclosed by a gear housing 127. The gear housing 127 provides an additional barrier to dust and debris, dampen noise, and to allow for subassembly.

Figure 5:
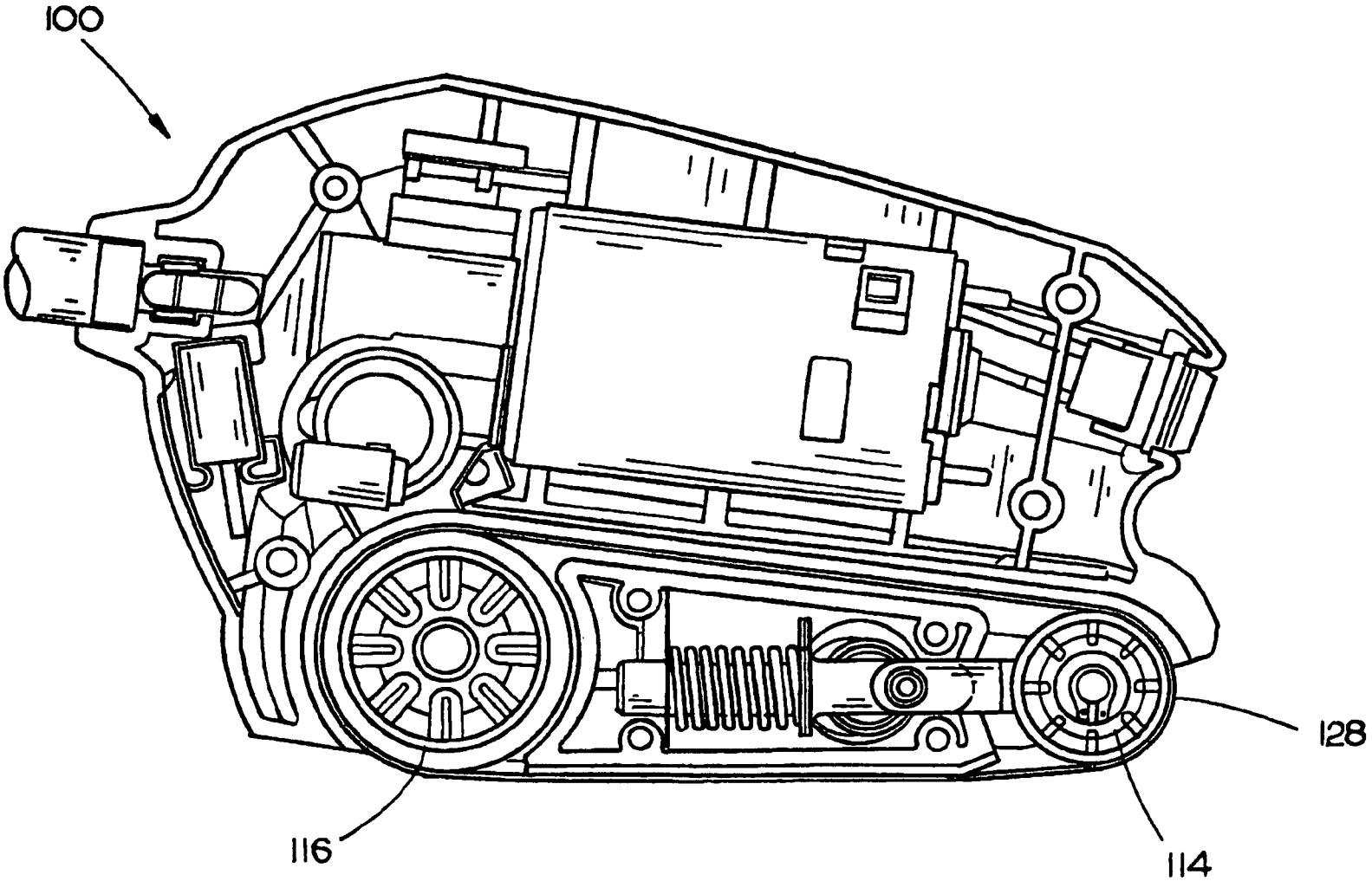
FIG. 5 is a cross-sectional view of the belt sander shown in FIG. 1, wherein a sanding assembly including a sanding belt wrapped around a front roller and a rear roller is illustrated.

Additionally, as demonstrated in FIG. 5, a sanding belt 128 includes abrasive material extending around the front roller 114 and the rear roller 116. In an exemplary embodiment, the sanding belt 128 is two and a fourth (2¼) inches wide and thirteen (13) inches long. In an alternative embodiment, the sanding belt 128 is two and a half (2½) inches wide and thirteen (13) inches long. Such size provides a maximum sanding surface while maintaining the size of the belt sander 100 to one which may fit snuggly within that of a typical human hand to allow for efficient control. It is contemplated that the type as well as the size of abrasive material included within the sanding belt may vary depending upon the users need such as to allow for less aggressive fine sanding.

In additional exemplary embodiments, the sanding assembly 104 includes a belt tensioning adjuster 130 allowing a user to apply or release tension to the sanding belt 128. For example, the sanding assembly 104 may include an extending platen to extend or shorten the path of travel of the sanding belt or to extend an idle roller forward and back. Further, an additional belt tracking adjuster 132 may also be included to allow for tool free alignment of the sanding belt 132. In an exemplary embodiment, the belt tracking adjuster 132 is included within the front of the sanding assembly 104. For example, if the sanding belt 128 starts to track to one side of the sander 100, a user may adjust the belt tracking by rotating the belt tracking adjuster 132 whereby clockwise movement of the belt tracking adjuster moves the belt to the right when facing the sander 100 while counterclockwise movement moves the belt to the left.

In use, the motor provides torque to the sanding assembly 104 via a gearing system 126 (e.g. a cross helical or worm drive gearing system) wherein such system transmits power to the drive belt pulley 118. In turn, the pitch belt 122 then transfers rotation from the drive belt pulley 118 to the driven pulley 120 and the rear sanding belt roller 116. The instant configuration thereby allows a user to operate the belt sander 100 vertically, horizontally or at various angles in-between.

In additional embodiments, it is contemplated that the belt sander 100 may include mechanisms designed to minimize or eliminate dust generated by fast sanding action. For example, in one embodiment, the belt sander 100 may include an integrated dust collection system which allows dust to be collected within a receptacle during operation. In an additional embodiment, the belt sander 100 may include a dust outlet allowing the belt sander 100 to be directly connected to a conventional shop vacuum hose or a centralized vacuum system. In further exemplary embodiments, a dust collection skirt may be included for managing dust generated during use. In an exemplary embodiment, the dust collection skirt may be located towards the rear of the sander 100 towards the power cord 134 in order to not interfere with the operation of the sander 100 and to direct dust away from the workpiece.

It is believed that the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A belt sander, comprising:

a sanding assembly having a front roller and a rear roller, the sanding assembly being configured to receive a sanding belt around the front roller and the rear roller to define a sanding surface therebetween;

a motor operable to provide rotational torque to the sanding assembly, the motor having a longitudinal rotational axis that is oriented in a substantially same direction of a longitudinal axis intersecting the front roller and the rear roller; and a housing generally encompassing the motor, the housing having a rear surface disposed opposite the motor from the rear roller, and a front surface disposed opposite the motor from the front roller, wherein a rear distance between the rear surface and the rear roller is greater than a front distance between the front surface and the front roller.

2. The belt sander as claimed in claim 1, wherein the motor is a high voltage direct current motor.

3. The belt sander as claimed in claim 1, further comprising a variable speed switch disposed generally on a front of the housing and operable to vary a speed of the motor in response to a user operation thereof.

4. The belt sander as claimed in claim 1, further comprising a variable speed dial disposed generally on a front of the housing and operable to vary a speed of the motor in response to a user operation thereof, and without requiring removal of a controlling hand of the user.

5. The belt sander as claimed in claim 1, further comprising a variable speed dial disposed generally on a front of the housing and positioned to vary the speed of the motor in response to a user operation thereof.

6. The belt sander as claimed in claim 1, further comprising:

a gearing system for transmitting torque from the motor to the sanding assembly; and a gear housing generally encompassing the gearing system.

7. A belt sander, comprising:

a sanding assembly having a front roller and a rear roller, the sanding assembly being configured to receive a sanding belt around the front roller and the rear roller to define a sanding surface therebetween;

motor operable to provide rotational torque to the sanding assembly, the motor having a longitudinal rotational axis that is oriented in a substantially same direction of a longitudinal axis intersecting the first roller and the second roller; and a housing coupled to the motor for enclosure and enclosing the motor, the housing having an outer surface opposite the motor from the sanding surface that is inclined toward the sanding surface between the rear roller from the front roller.

8. The belt sander as claimed in claim 7, further comprising a power switch disposed generally on a front of the housing and operable to control the transmission of electricity to the motor.

9. The belt sander as claimed in claim 7, further comprising a variable speed switch disposed generally on a front of the housing and operable to vary the speed of the motor in response to a user operation of the variable speed switch.

10. The belt sander as claimed in claim 7, further comprising a variable speed dial disposed generally on a front of the housing and operable to vary the speed of the motor in response to operation thereof by a user of the variable speed dial, without requiring removal of a controlling hand of the user.

11. The belt sander as claimed in claim 7, further comprising a variable speed dial disposed generally on a front of the housing and positioned to vary the speed of the motor in response to user operation of the variable speed dial.

12. The belt sander as claimed in claim 7, wherein the front roller has a smaller diameter than the rear roller.

13. A belt sander, comprising:

a sanding assembly having a front roller and a rear roller, the sanding assembly being configured to receive a sanding belt around the front roller and the rear roller to define a substantially flat sanding surface therebetween;

a motor operable to provide rotational torque to the sanding assembly, the motor having a longitudinal rotational axis that is oriented in a substantially same direction of a longitudinal axis intersecting the first roller and the second roller and parallel with the substantially flat sanding surface; and a housing coupled to the motor for enclosure of the motor, the housing having an inclined surface relative to the longitudinal rotational axis of the motor and relative to the substantially flat sanding surface.

14. The belt sander as claimed in claim 13, wherein the housing defines an indentation for a user's thumb.

15. The belt sander as claimed in claim 13, further comprising a variable speed dial disposed generally on a front of the housing and operable to vary the speed of the motor in response to operation of the variable speed dial by a finger of a user.

16. The belt sander as claimed in claim 13, wherein the front roller has a smaller diameter than the rear roller.

* * * * *